US010220401B2

(12) United States Patent
Puviland et al.

(10) Patent No.: US 10,220,401 B2
(45) Date of Patent: Mar. 5, 2019

(54) DEVICE FOR PACKAGING AND DISTRIBUTING PRODUCT HAVING A CHILD-PROTECTION ARRANGEMENT

(71) Applicant: LABLABO, Juvigny (FR)

(72) Inventors: Patrice Puviland, Eteaux (FR); Jean-Philippe Taberlet, Villard (FR)

(73) Assignee: LABLABO, Juvigny (FR)

( * ) Notice: Subject to any disclaimer, the term of this patent is extended or adjusted under 35 U.S.C. 154(b) by 0 days.

(21) Appl. No.: 15/545,543

(22) PCT Filed: Jan. 5, 2016

(86) PCT No.: PCT/FR2016/050006
§ 371 (c)(1),
(2) Date: Jul. 21, 2017

(87) PCT Pub. No.: WO2016/120537
PCT Pub. Date: Aug. 4, 2016

(65) Prior Publication Data

US 2017/0348717 A1 Dec. 7, 2017

(30) Foreign Application Priority Data

Jan. 27, 2015 (FR) ..... 15 50603

(51) Int. Cl.
*B05B 11/00* (2006.01)
*A45D 34/00* (2006.01)

(52) U.S. Cl.
CPC ..... *B05B 11/3059* (2013.01); *A45D 34/00* (2013.01); *B05B 11/00416* (2018.08);
(Continued)

(58) Field of Classification Search
CPC ..... B05B 11/3059
(Continued)

(56) References Cited

U.S. PATENT DOCUMENTS

2007/0080173 A1 4/2007 Coe et al.
2010/0133299 A1* 6/2010 Guenther ..... B05B 11/3059 222/153.13

(Continued)

FOREIGN PATENT DOCUMENTS

DE 3706963 10/1988
FR 2243886 4/1975

(Continued)

OTHER PUBLICATIONS

Search Report dated Nov. 19, 2015.

*Primary Examiner* — J. Casimer Jacyna
(74) *Attorney, Agent, or Firm* — Ipsilon USA, LLP

(57) ABSTRACT

The invention relates to a device for packaging and dispensing a product, comprising a pump head (1) that can be actuated by applying pressure along a central longitudinal axis (A-A) for a product dispensing operation, and a support device which is associated with this pump head and is fixed to the opening (2) of a bottle containing the product, this support device comprising a lock (6) held on said opening and a locking arrangement (7) comprising at least one locking tab (8) that can be moved by applying pressure to at least one lateral contact area (9) and bears a locking cam (10) of the pump head, said cam (10) being arranged under the pump head (1) and forming a stop for blocking the internal end (1A) of the pump head, in a non-actuated locked position.

According to the invention, the device comprises at least one said lateral contact area (9) borne by a skirt section borne by a radially elastically deformable ring bearing two said locking tabs that are arranged in a diametrically opposite manner, this skirt section being arranged at an equal distance from each of these tabs, and said cam (10) consisting of a (Continued)

radial flange borne by each of said locking tabs parallel to said central longitudinal axis.

6 Claims, 5 Drawing Sheets

(52) U.S. Cl.
CPC .... *B05B 11/3047* (2013.01); *A45D 2200/056* (2013.01); *A45D 2200/057* (2013.01)

(58) Field of Classification Search
USPC ..... 222/153.13
See application file for complete search history.

(56) References Cited

U.S. PATENT DOCUMENTS

| | | | | |
|---|---|---|---|---|
| 2014/0097207 | A1* | 4/2014 | Szymiczek | B05B 11/0032 222/153.13 |
| 2014/0144943 | A1* | 5/2014 | Kim | B05B 11/3097 222/153.13 |
| 2014/0246460 | A1 | 9/2014 | Lee | |
| 2015/0328651 | A1* | 11/2015 | Hohmann | B05B 11/3059 604/192 |
| 2015/0367367 | A1* | 12/2015 | Lefevre | B65D 50/065 222/153.13 |

FOREIGN PATENT DOCUMENTS

| | | |
|---|---|---|
| FR | 2893598 | 5/2007 |
| WO | 2012103740 | 8/2012 |

* cited by examiner

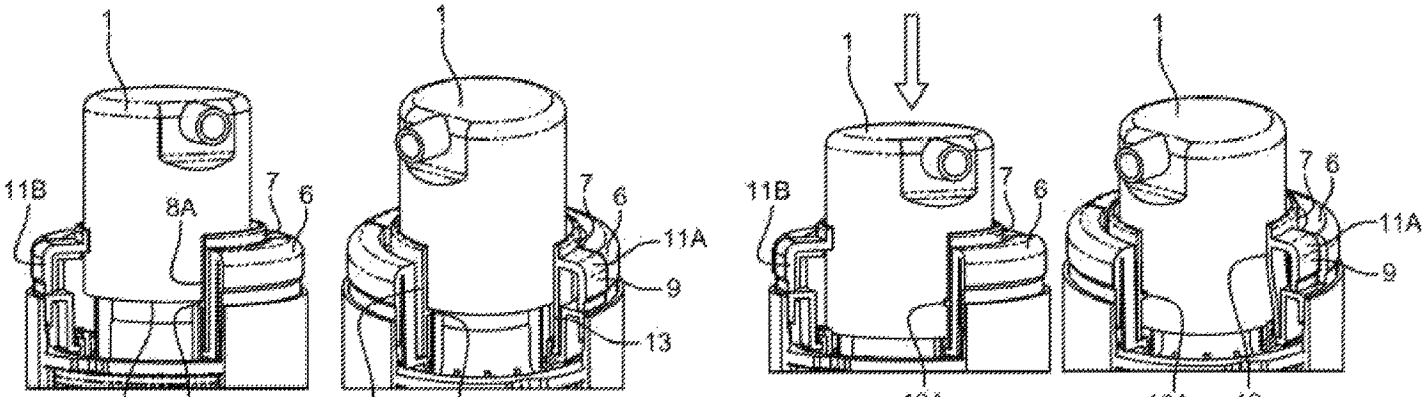
Fig. 2
Fig. 3
Fig. 5
Fig. 6
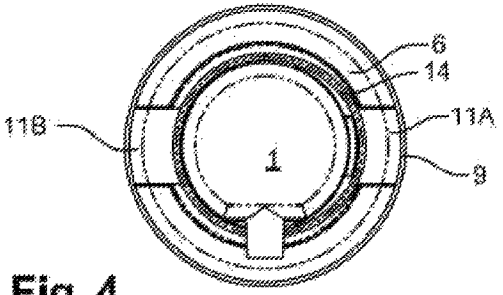
Fig. 4
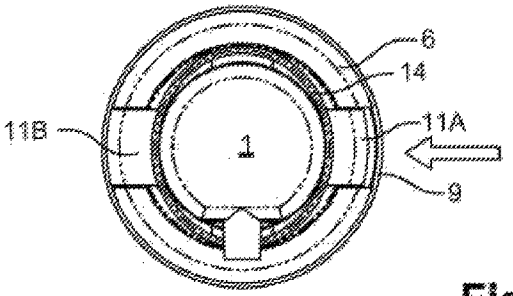
Fig. 7

DEVICE FOR PACKAGING AND DISTRIBUTING PRODUCT HAVING A CHILD-PROTECTION ARRANGEMENT

RELATED APPLICATION

This application is a National Phase of PCT/FR2016/050006, filed on Jan. 5, 2016 which in turn claims the benefit of priority from French Patent Application No. 15 50603, filed on Jan. 27, 2015, the entirety of which are incorporated by reference.

BACKGROUND

Field of the Invention

The invention relates to a device for packaging and dispensing a product, having a child-protection arrangement.

More precisely, the invention relates to a device for packaging and dispensing a product, comprising a pump head that can be actuated by applying pressure along a central longitudinal axis for a product dispensing operation, and a support device which is associated with this pump head and is fixed to the opening of a bottle containing the product, this support device comprising a lock held on said opening and a locking arrangement comprising at least one locking tab that can be moved by applying pressure to at least one lateral contact area and bears a locking cam of the pump head.

Description of Related Art

The patent US 2003/0010793 discloses such a device for packaging and dispensing a product, having a child-protection arrangement, the idea of which is to complicate the operation of the pump so that a child cannot dispense product.

This device comprises a pump head which can be actuated by applying pressure along a central longitudinal axis in order to perform a dispensing operation, and a support unit which is associated with this pump head and which can be fixed to an opening area of a storage bottle of the product. The pump head is held in an inactive blocking position with the help of manually unlockable locking means.

A closing part of the support unit is held on the opening area of the bottle by means of a lock which prevents this closing part from being released from the outlet area of the bottle, and means are provided to unlock the lock.

The support unit also comprises a locking part that can be rotated about a central longitudinal axis relative to the closing part.

The locking members are two locking tabs arranged in an opposite manner on the locking part. These two locking tabs are curved substantially at right angles to their upper edge in a similar manner to the upper edge of the outer skirt of the locking part, and each comprises, at this edge, a locking element in the form of a locking cam associated with a corresponding locking cavity of the pump head. The two locking tabs are integrated into a single piece with the skirt of the locking element and are resiliently movable by virtue of two longitudinal slots which are provided on their two longitudinal sides, are parallel and open at their upper edge.

When lateral manual pressure is applied to contact surfaces under these locking tabs, these tabs are pivoted outward, and this causes the locking cams to disengage from the corresponding cavity of the pump head. The pump head can then be rotated to transfer it to an operational position, up to a stop. Simultaneously with the compression of the outer skirt of the locking part in the area of the contact surfaces, the pump head is thus rotated in order to prevent the locking cams from engaging in the corresponding cavity of the pump head again and, in this rotated position, it can be pressed along the central longitudinal axis in order to perform a dispensing operation.

Conversely, a geometric locking tooth arrangement arranged on the top edge of the closure part prevents the locking part from rotating when the pump head is rotated back to its initial position.

Such an arrangement raises the following technical problems.

This arrangement is relatively complex.

Its operation is also relatively complex and requires two associated movements in order to unlock the child protection: lateral pressure on the contact surfaces under the locking tabs and simultaneous rotation of the pump head. This system thus cannot be used with one hand.

After the pump has been used and the product dispensed, it is necessary to release the contact surfaces under the locking tabs and rotate the pump head in the opposite direction to its initial position, where the locking cams fit back into the corresponding cavity of the pump head. Re-locking the arrangement in the child protection position is therefore not automatic after use and this locking rotation can be omitted by an adult using the bottle, this being highly detrimental to effective child protection.

The same applies to the device described in patent document EP 2 660 164.

That document describes a device for packaging and dispensing product, comprising a pump head that can be actuated by applying pressure along a central longitudinal axis for a product dispensing operation, and a support device which is associated with this pump head and is fixed to the opening of a bottle containing the product. This support device comprises a lock held on said opening and a locking arrangement comprising at least one locking member that can be moved by applying pressure to at least one lateral contact area. The locking member is arranged under the pump head and forms a stop for blocking the internal end of the pump head, in a non-actuated locked position.

After the pump has been used and the product dispensed, it is necessary to push the locking member in the opposite direction by virtue of an opposite lateral contact area, in order for the pump to return to the locked position. As above, the re-locking of the arrangement in the child-protection position is therefore not automatic after use.

OBJECTS AND SUMMARY

The invention solves this problem and proposes a device for packaging and dispensing a product, having a simple and effective child-protection arrangement.

To this end, the invention proposes a device for packaging and dispensing a product, comprising a pump head that can be actuated by applying pressure along a central longitudinal axis for a product dispensing operation, and a support device which is associated with this pump head and is fixed to the opening of a bottle containing the product, this support device comprising a lock held on said opening and a locking arrangement comprising at least one locking tab that can be moved by applying pressure to at least one lateral contact area and bears a locking cam of the pump head, said cam being arranged under the pump head and forming a stop for blocking the internal end of the pump head, in a non-actuated locked position, characterized in that the device comprises at least one said lateral contact area borne by a skirt section borne by a radially elastically deformable ring bearing two said locking tabs that are arranged in a diametrically opposite manner, this skirt section being arranged at an equal distance from each of these tabs, and in that said cam consists of a radial flange borne by each of said locking tabs parallel to said central longitudinal axis.

According to a first embodiment, the device comprises a second skirt section that is arranged on the diametrically opposite side from said skirt section and is fixed to the lock by snap-fastening.

According to a second embodiment, the device comprises two said lateral contact areas, each borne by a skirt section borne by said radially elastically deformable ring bearing two said locking tabs that are arranged in a diametrically opposite manner, these skirt sections being arranged in a diametrically opposite manner, at an equal distance from each of these tabs.

Said locking arrangement may be secured to said lock by snap-fastening of a pawl borne by at least one elastically deformable fixing tab that is integral with said ring.

In this case, preferably, said fixing tab is integral with said skirt section.

Said lock may comprise an annular part projecting from the bottle and surrounding the pump head, this annular part comprising at least one cavity for receiving said skirt section bearing said lateral contact area.

BRIEF DESCRIPTION OF THE DRAWINGS

The invention is described in more detail with reference to the figures which show only preferred embodiments of the invention.

FIGS. 2 and 3 are partially cutaway perspective views of the device according to a first alternative embodiment, in the locked position.

FIG. 4 is a top view of the device according to this first alternative embodiment, in the locked position.

FIGS. 5 and 6 are partially cutaway perspective views of the device according to this first alternative embodiment, in the unlocked position.

FIG. 7 is a top view of the device according to this first alternative embodiment, in the unlocked position.

DETAILED DESCRIPTION

Figure 1:
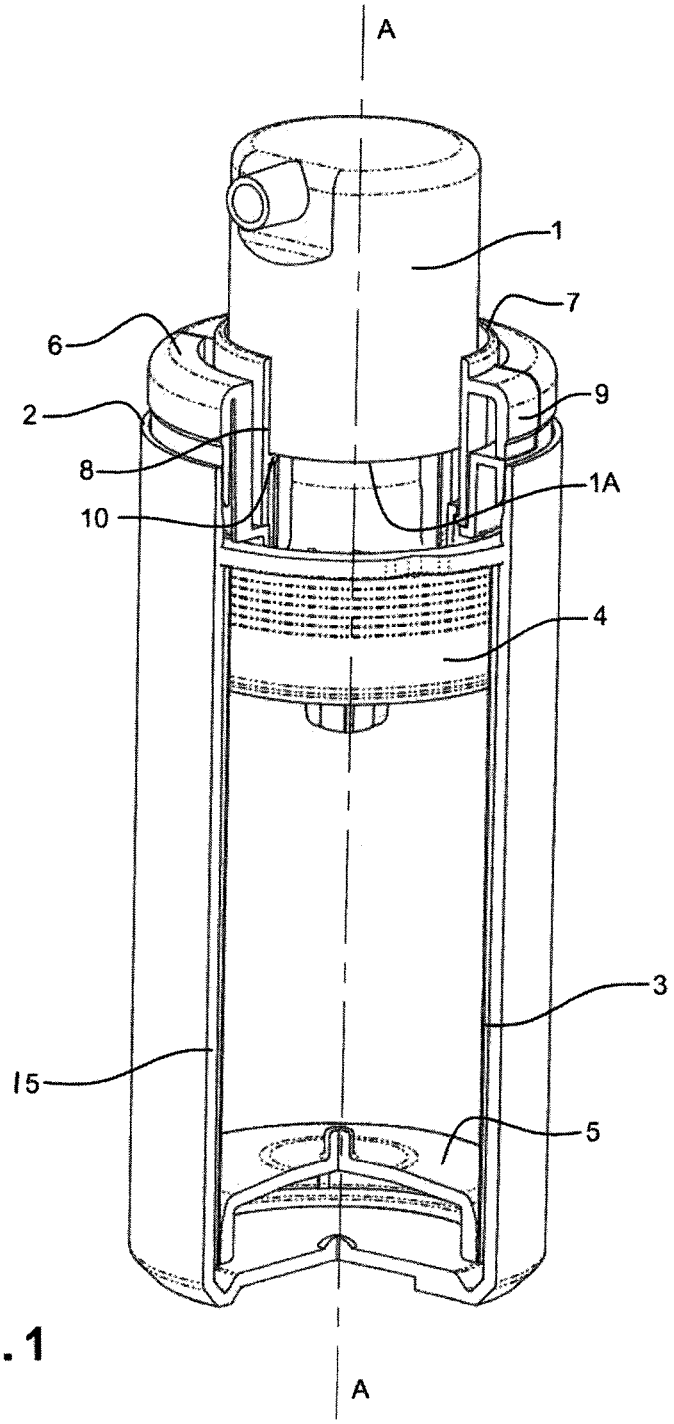
FIG. 1 is a partially cutaway perspective view of a device according to the invention.

As shown in FIG. 1, a device for packaging and dispensing a product comprises a pump head 1 that can be actuated by applying pressure along a central longitudinal axis A-A for a product dispensing operation, and a support device which is associated with this pump head 1 and is fixed to the opening 2 of a bottle containing the product.

According to the example shown, the device comprises a flexible pouch 3 that is equipped with two rigid flanges 4, 5 and contained in an external rigid bottle 15.

The support device comprises a lock 6 held on the opening 2 of the bottle and a locking arrangement 7 comprising at least one locking tab 8 that is parallel to said central longitudinal axis A-A and can be moved by applying pressure to at least one contact area 9 and bears a locking cam 10 of the pump head.

This cam 10, which consists of a radial flange borne by the locking tab 8, is arranged below the pump head 1 and forms a stop for blocking the internal end 1A of the pump head, in a non-actuated locked position, as shown in FIG. 1.

A first variant of the device is shown in FIGS. 2 to 9.

Figure 8:
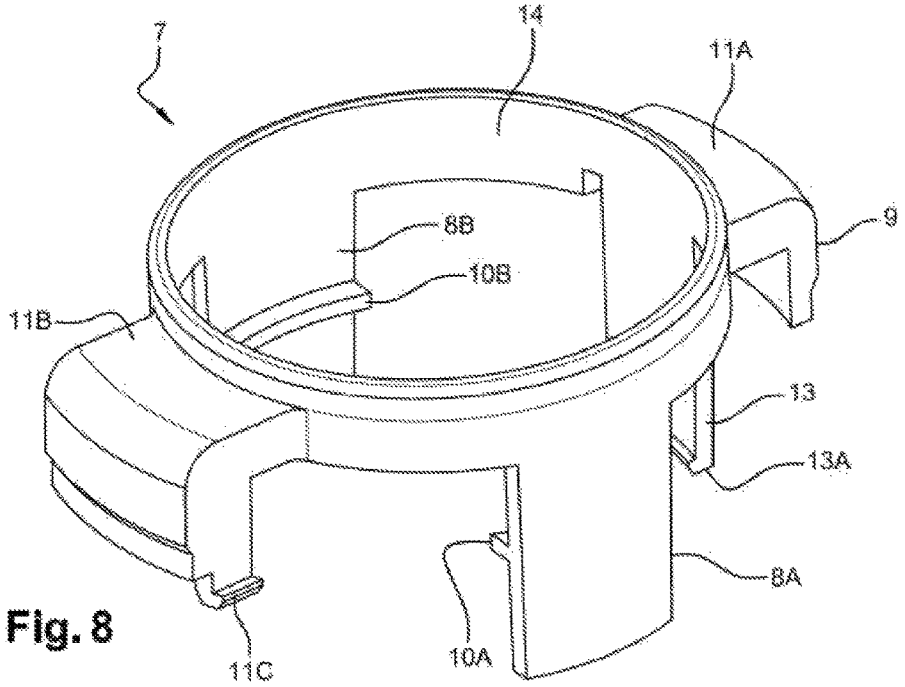
FIGS. 8 and 9 are perspective views of parts of the device according to this first alternative embodiment.

As is particularly visible in FIG. 8, which shows a perspective view of the locking arrangement 7, this arrangement comprises a lateral contact area 9 borne by a skirt section 11A borne by a radially elastically deformable ring 14 bearing two locking tabs 8A and 8B that are arranged in a diametrically opposite manner, this skirt section 11A being arranged at an equal distance from each of these tabs 8A and 8B.

Figure 9:
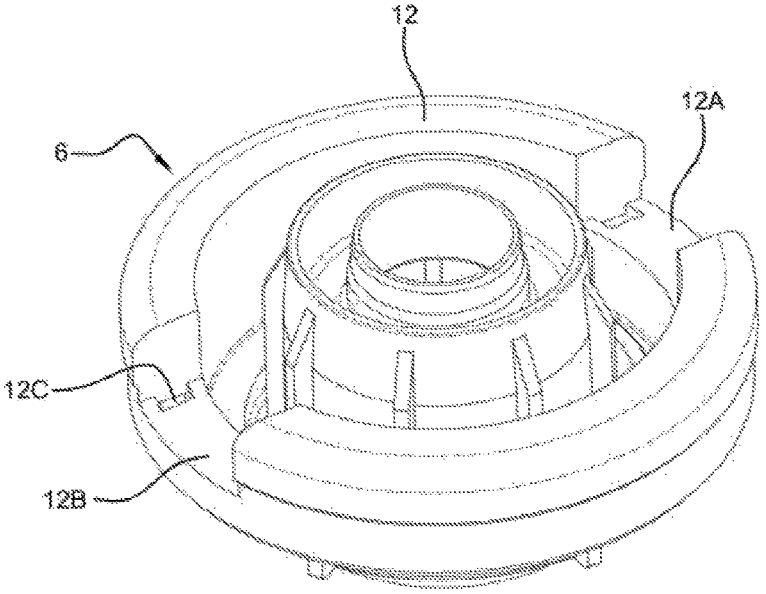

As is particularly visible in FIG. 9, which shows a perspective view of the lock 6 that supports the pump body by way of its central part, the lock comprises an annular part 12 intended to protrude from the bottle and to surround the pump head 1, this annular part comprising a cavity 12A for receiving the skirt section 11A bearing the lateral contact area 9.

The locking arrangement 7 is secured to the lock 6 by snap-fastening of a pawl 13A borne by an elastically deformable fixing tab 13 integral with the ring 14 and more precisely with the skirt section 11A.

In order to ensure that the locking tabs 8A and 8B move correctly, as will be seen below, a second skirt section 11B is provided on the locking arrangement 7, on the diametrically opposite side from the first skirt section 11A mentioned above. This second skirt section 11B is snap-fastened to the lock 6 by means of two pawls 11C which are intended to be snap-fastened in two openings 12C arranged in a second cavity 12B for receiving the second skirt section 11B.

The locking and unlocking functions with these parts will now be described.

In FIGS. 2 to 4, the device and the constituent parts thereof are in the locked rest position. The ring 14 of the locking arrangement 7 thus has a non-deformed circular cross section and the cams 10A and 10B borne by the locking tabs 8A and 8B are arranged under the pump head 1 and form stops for blocking the internal end 1A of the pump head, in the non-actuated locked position, preventing a child from actuating it by simply pressing on it.

The ring 14 is elastically deformed by applying lateral pressure to the contact area 9, as illustrated by an arrow in FIG. 7, while being retained by the second skirt section 11B and its section thus takes on an oblong shape which causes the locking tabs 8A and 8B to move, the cams 10A and 10B of which are moved outward and release the internal end 1A of the pump head 1 which can be pressed along the central longitudinal axis and lowered as illustrated by an arrow in FIG. 5. According to this first variant, it will be observed that the unlocking and the dispensing of product can be performed easily with one hand. The product is then dispensed and, as illustrated in FIGS. 2 to 4, all that is necessary is to stop applying pressure on the pump head 1 and on the lateral contact area 9 in order for the pump head 1 to return to the rest position under the action of its return spring and for the cams 10A and 10B borne by the locking tabs 8A and 8B to return, by virtue of the intrinsic elasticity of the ring 14, to form stops for blocking the internal end 1A of the pump head. The latter is thus locked again without active intervention by the user, thereby eliminating any risk of forgetting to relock the pump after using it, as illustrated in FIGS. 2 to 4.

A second variant of the device is shown in FIGS. 10 to 17.

Figure 16:
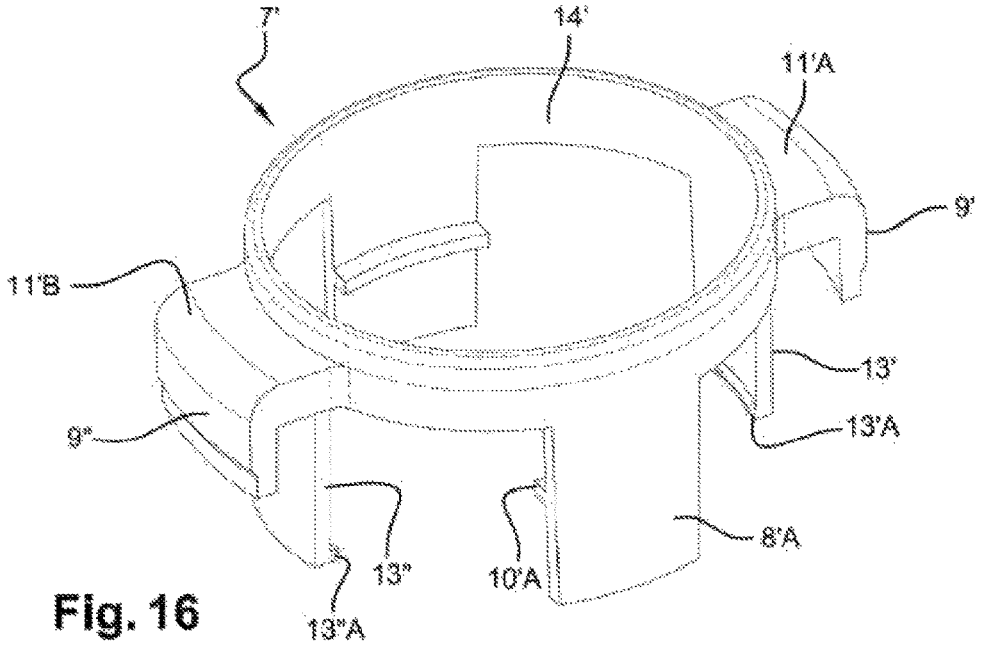
FIGS. 16 and 17 are perspective views of parts of the device according to this second alternative embodiment.

As is particularly visible in FIG. 16, which shows a perspective view of the locking arrangement 7', this arrangement comprises two lateral contact areas 9' and 9", each borne by a skirt section 11'A and 11'B borne by a radially elastically deformable ring 14' also bearing two locking tabs 8'A and 8'B arranged in a diametrically opposite manner, these skirt sections 11'A and 11'B being arranged in a diametrically opposite manner, at an equal distance from each of these tabs 8'A and 8'B.

Figure 17:
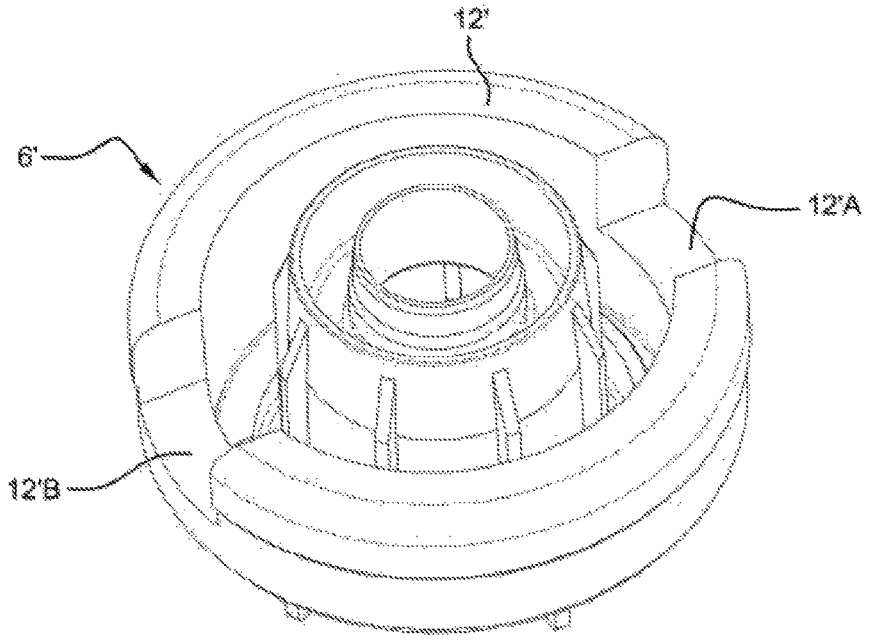

As is particularly visible in FIG. 17, which shows a perspective view of the lock 6' that supports the pump body by way of its central part, the lock comprises an annular part 12' intended to protrude from the bottle and to surround the pump head 1, this annular part comprising two cavities 12'A and 12'B for receiving each skirt section 11'A and 11'B each bearing a lateral contact area 9' and 9".

The locking arrangement 7' is secured to the lock 6' by snap-fastening of two pawls 13'A and 13"A, each borne by a fixing tab 13' and 13" integral with the ring 14' and more precisely with each symmetrical skirt section 11'A and 11'B.

The locking and unlocking functions with these parts will now be described.

Figure 11:
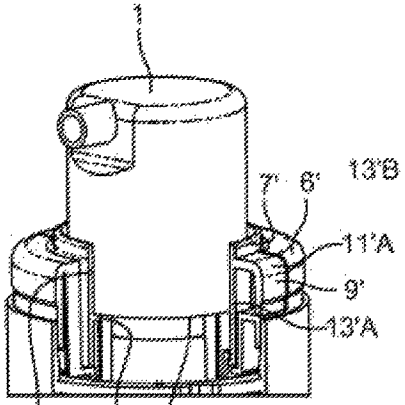
FIGS. 10 and 11 are partially cutaway perspective views of the device according to a second alternative embodiment, in the locked position.
Figure 10:
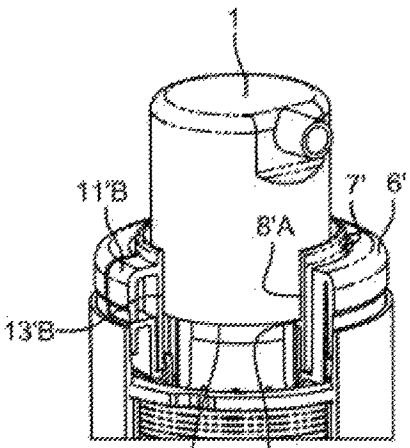
Figure 12:
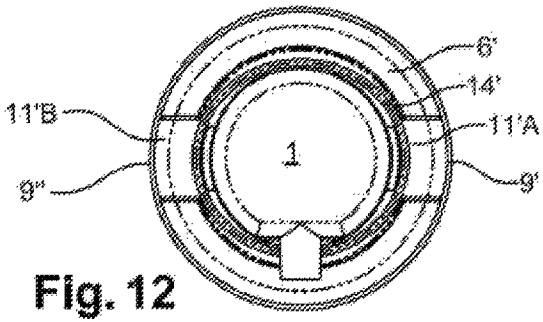
FIG. 12 is a top view of the device according to this second alternative embodiment, in the locked position.

In FIGS. 10 to 12, the device and the constituent parts thereof are in the locked rest position. The ring 14' of the locking arrangement 7' thus has a non-deformed circular cross section and the two cams 10'A and 10'B borne by the locking tabs 8'A and 8'B are arranged under the pump head 1 and form stops for blocking the internal end 1A of the pump head, in the non-actuated locked position, preventing a child from actuating it by simply pressing on it.

Figure 14:
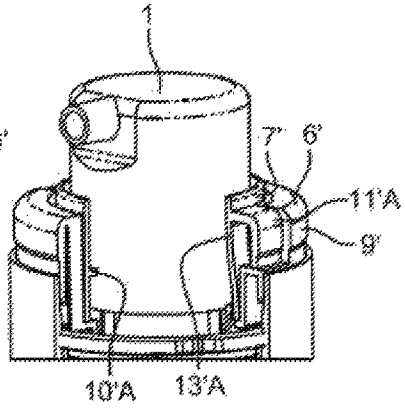
FIGS. 13 and 14 are partially cutaway perspective views of the device according to this second alternative embodiment, in the unlocked position.
Figure 13:
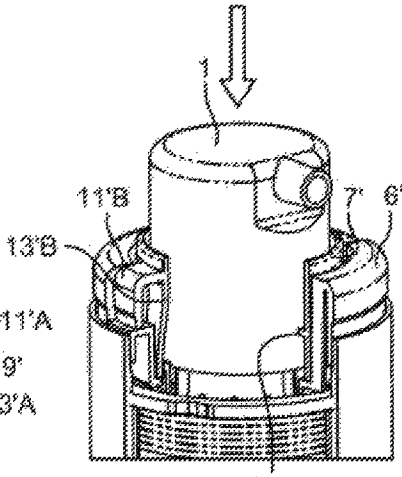
Figure 15:
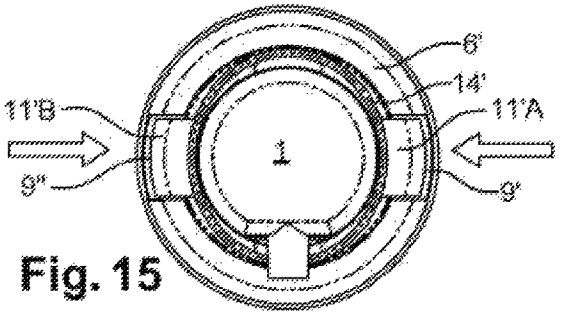
FIG. 15 is a top view of the device according to this second alternative embodiment, in the unlocked position.

The ring 14' is elastically deformed by applying lateral pressure to the contact areas 9' and 9", as illustrated by the two arrows in FIG. 15, and its cross section thus takes on an oblong shape which causes the locking tabs 8'A and 8'B to move, the cams 10'A and 10'B of which are moved outward and, release the internal end 1A of the pump head 1 which can be pressed along the central longitudinal axis and lowered as illustrated by an arrow in FIGS. 13 and 14. The product is then dispensed and, as illustrated in FIGS. 10 to 12, all that is necessary is to stop applying pressure on the pump head 1 and on the lateral contact areas 9' and 9" in order for the pump head 1 to return to the rest position under the action of its return spring and for the cams 10A and 10B borne by the locking tabs 8A and 8B to return, by virtue of the intrinsic elasticity of the ring 14', to form stops for blocking the internal end 1A of the pump head. The latter is thus locked again without active intervention by the user, thereby eliminating any risk of forgetting to relock the pump after using it.

The invention claimed is:

1. A device for packaging and dispensing a product, comprising:

a pump head that can be actuated by applying pressure along a central longitudinal axis for a product dispensing operation, and a support device which is associated with this pump head and is fixed to the opening of a bottle containing the product, this support device comprising a lock held on said opening and a locking arrangement comprising at least one locking tab that can be moved by applying pressure to at least one lateral contact area and bears a locking cam of the pump head, said cam being arranged under the pump head and forming a stop for blocking the internal end of the pump head, in a non-actuated locked position, wherein said at least one lateral contact area is borne by a skirt section borne by a radially elastically deformable ring bearing two said locking tabs that are arranged in a diametrically opposite manner, this skirt section being arranged at an equal distance from each of these tabs, and in that said cam consists of a radial flange borne by each of said locking tabs, said locking tabs being parallel to said central longitudinal axis.

2. The device as claimed in claim 1, wherein said device further comprises a second skirt section that is arranged on the diametrically opposite side from said skirt section and is fixed to the lock by snap fastening.

3. The device as claimed in claim 2, wherein said device further comprises two said lateral contact areas, each borne by a skirt section borne by said radially elastically deformable ring bearing two said locking tabs that are arranged in a diametrically opposite manner, these skirt sections being arranged in a diametrically opposite manner, at an equal distance from each of these tabs.

4. The device as claimed in claim 1, wherein said locking arrangement is secured to said lock by snap-fastening of a pawl borne by at least one elastically deformable fixing tab that is integral with said ring.

5. The device as claimed in claim 4, wherein said fixing tab is integral with said skirt section.

6. The device as claimed in claim 1, wherein said lock comprises an annular part projecting from the bottle and surrounding the pump head, this annular part comprising at least one cavity for receiving said skirt section bearing said lateral contact area.

* * * * *